United States Patent [19]

Graebe

[11] Patent Number: 4,953,913

[45] Date of Patent: Sep. 4, 1990

[54] CONTOURED SEAT BASE

[76] Inventor: Robert H. Graebe, 4 Signal Hill Blvd., Belleville, Ill. 62223

[21] Appl. No.: 266,867

[22] Filed: Nov. 3, 1988

[51] Int. Cl.[5] ..... A47C 7/16; A47C 7/62

[52] U.S. Cl. ..... 297/459; 297/DIG. 2; 297/DIG. 4; 5/446

[58] Field of Search ..... 297/452, 458, 459, 460, 297/DIG. 2, DIG. 4; 5/431, 446, 447

[56] References Cited

U.S. PATENT DOCUMENTS

| | | | |
|---|---|---|---|
| 3,463,547 | 8/1969 | Brennan et al. | 297/459 |
| 3,503,649 | 3/1970 | Johnson | 297/459 |
| 4,726,624 | 2/1988 | Jay | 297/459 |
| 4,753,480 | 6/1988 | Morell | 297/459 X |
| 4,819,286 | 4/1989 | Beauchamp | 297/DIG. 4 X |

FOREIGN PATENT DOCUMENTS

| | | | |
|---|---|---|---|
| 2933058 | 2/1981 | Fed. Rep. of Germany | 297/452 |
| 1003035 | 9/1965 | United Kingdom | 297/DIG. 2 |

*Primary Examiner*—Peter R. Brown

*Attorney, Agent, or Firm*—Gravely, Lieder & Woodruff

[57] ABSTRACT

A seat base is interposed between a supporting surface, such as the sling-type seat of a wheelchair, and a cushion or even the user, it having a lower contour which generally matches the contour of the supporting surface and a upper contour which provides a comfortable seating surface or gives a desired shape to an overlying cushion. The lower contour is established by a plurality of transversely directed ribs, whereas the upper contour is established by transversely directed panels located between the ribs. The polymer material from which the seat base is formed has uniform thickness and as a consequence the ribs create grooves that open out of the upper surface to separate the panels.

20 Claims, 5 Drawing Sheets

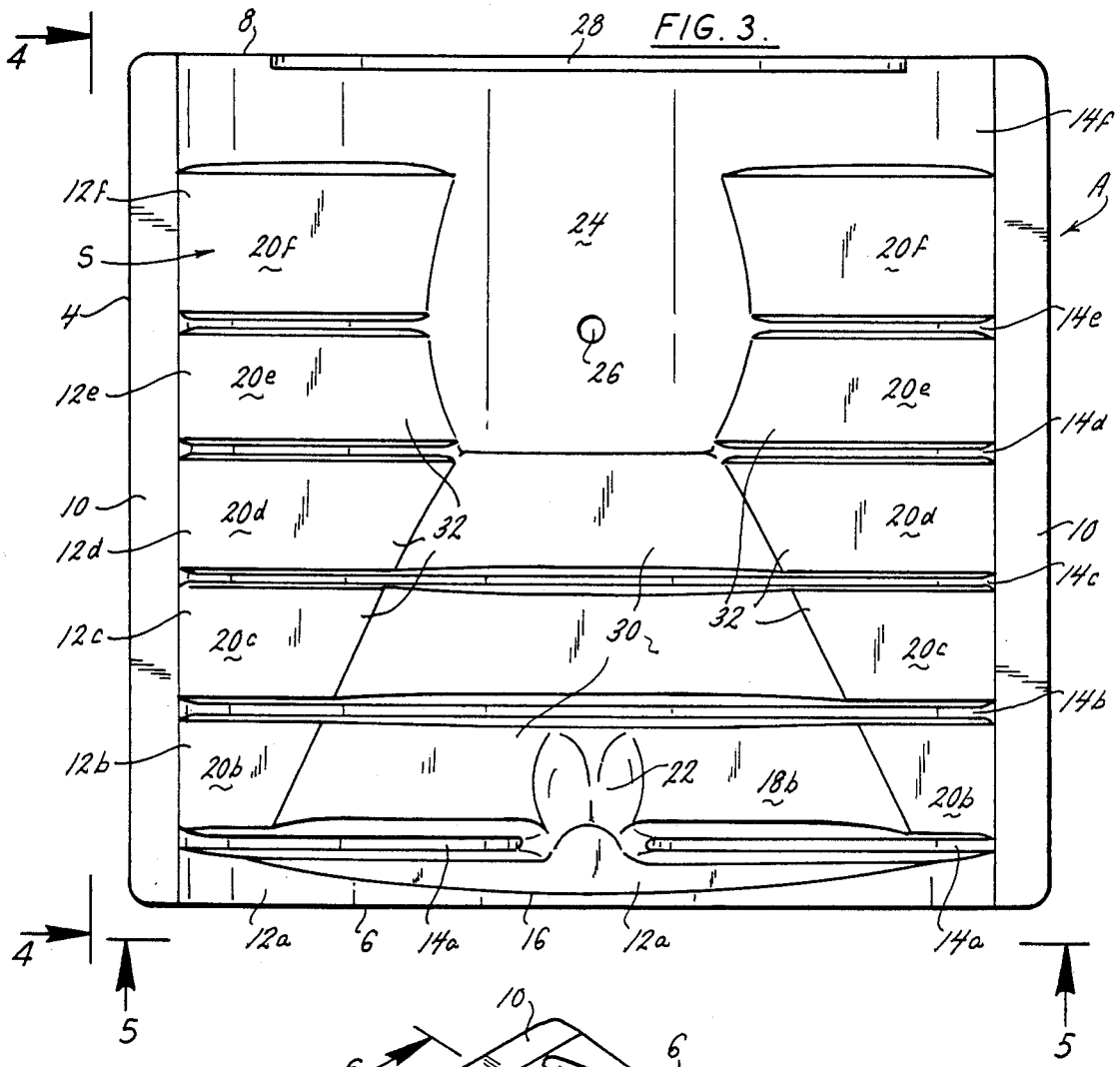
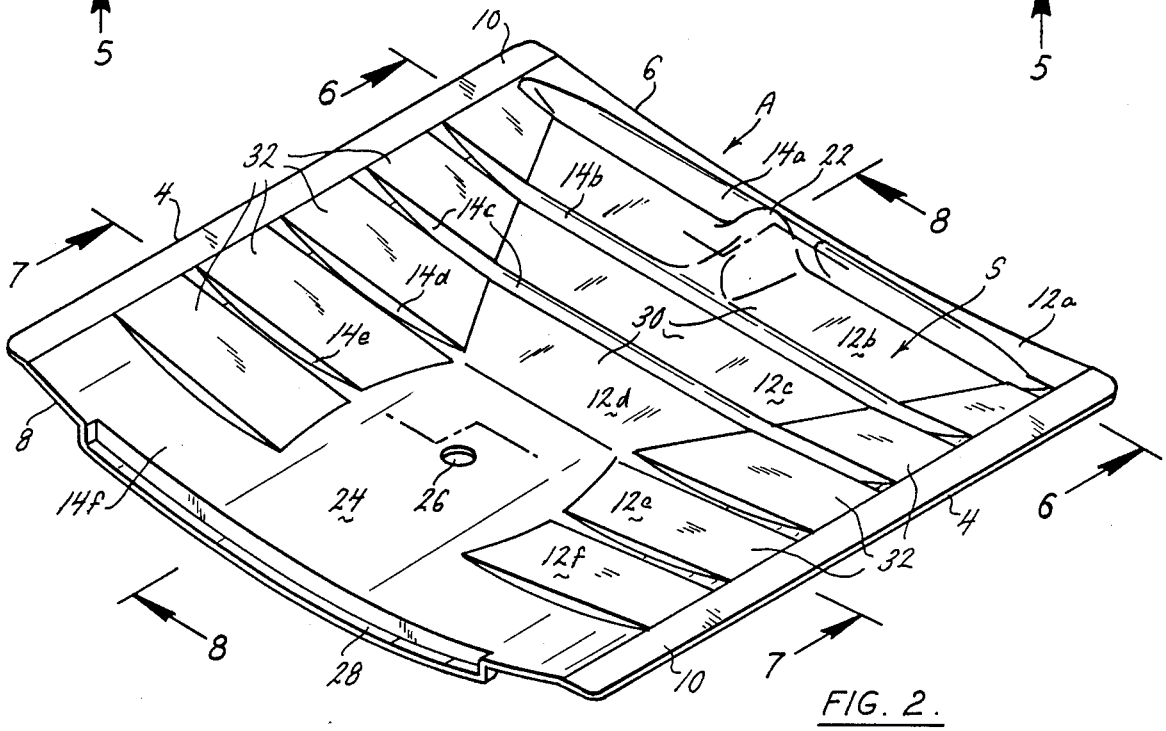
FIG. 2.

CONTOURED SEAT BASE

BACKGROUND OF THE INVENTION

This invention relates in general to seating and, more particularly, to a device for providing a seating surface with a desired contour and to a seating arrangement formed with the device.

The typical wheelchair has side frames which move together to enable the chair to be reduced to a more compact configuration—one suitable for storage or transport. To accommodate this conversion, the typical wheelchair has attached to its side frames a sling-type seat, which being flexible, simply folds upon itself as the side frames move together. While the sling-type seat nicely facilitates the conversion between open and closed positions, it does not serve the occupant's needs in other more important respects. Such seats become uncomfortable after prolonged periods, and much worse, concentrate the occupant's weight at the bony protuberances of the buttocks, thus inducing decubitus ulcers, more commonly known as bed sores.

The problem resides primarily in the inherent curvature of the sling-type seat—a generally uniform curvature which resembles that of a hammock. It tends to urge the occupant's thighs together, making them difficult to spread, particularly for one so crippled as to be confined to the wheelchair. While the seat has flexibility, it has little resiliency in the vertical direction and as a consequence most of the occupant's weight is transferred to the seat in the region of the bony protuberances of the buttocks. Without the circulation induced by movement, decubitus ulcers may well develop in the region of the bony protuberances.

Cellular cushions, such as those disclosed in U.S. Pat. Nos. 4,005,236 and 4,541,136 of R. H. Graebe, substantially reduce the incidence of decubitus ulcers from wheelchair occupancy. These cushions interpose a multitude of air cells between the sling-type seat and the buttocks of the occupant, and these air cells deflect to accommodate the contour of the occupant's body. Since the air cells are interconnected, each cell exerts essentially the same restoring force on the body irrespective of the magnitude of its deflection. Thus, the region of the bony protuberances in the buttocks floats and bears no greater weight than other areas of the buttocks, and decubitus ulcers are less likely to develop.

Nevertheless, a flotation-type cellular cushion having a flexible backing and air cells of low height to a measure tends to assume the contour of the support on which it rests. Such a cellular cushion, when placed on a sling-type wheelchair seat, might not distribute the suspension forces well enough to overcome the curvature of the seat and as a consequence the cushion may confine the occupant laterally to an excessive measure, thus forcing the occupant's thighs together in an uncomfortable manner.

The present invention resides in a light weight base or tray having generally uniform thickness throughout, insofar as the material from which it is formed is concerned, yet having ribs which impart rigidity and the desired lower contour to it. The upper surface, on the other hand, possesses a contour suitable for seating, particularly as an underlying support for a cushion, since it enhances the effective depth of immersion in the buttocks area.

DESCRIPTION OF THE DRAWINGS

In the accompanying drawings which form part of the specification and wherein like numerals and letters refer to like parts wherever they occur.

FIG. 2 is a perspective view of the seat base;

FIG. 3 is a top plan view of the seat base.

DETAILED DESCRIPTION

Figure 1:
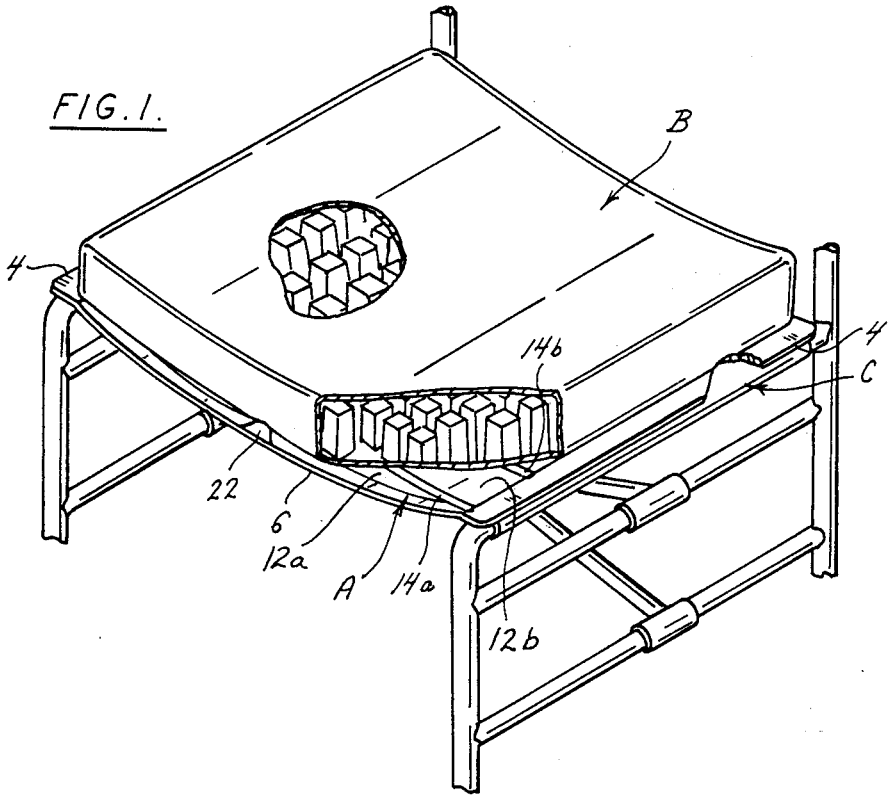
FIG. 1 is a perspective view showing a sling-type seat supporting a seat base constructed in accordance with and embodying the present invention, with the seat base in turn supporting a cellular cushion.

Referring now to the drawings, a rigid seat base A (FIGS. 1–3) is formed from a suitable generally rigid polymer which is molded such that it has generally uniform thickness throughout, yet the contour of its upwardly presented surface differs significantly from the contour of its downwardly presented surface. In particular, its upwardly presented surface has an effective contour s (FIG. 2) which is configured to serve as a seating surface itself or to function as an underlying support for a cushion B—a support that imparts a desired contour to the cushion B. The downwardly presented surface, on the other hand, has an effective contour t (FIGS. 4–8) which may match the contour of an underlying supporting surface on which the seat base A rests. The seat base A is ideally suited for use between a cellular cushion B of the type disclosed in U.S. Pat. Nos. 4,005,236 and 4,541,136 granted to R. H. Graebe and a sling-type seat C of a wheel chair (FIG. 1). The seat C sags intermediate its sides, and were it not for the seat base A, the cellular cushion B might excessively confine the user, at least laterally and perhaps urge the user's thighs together with too much force. The upper contour s provides a more level supporting surface for the cushion B, yet is shaped to enable the cushion B to afford optimum comfort. The lower contour t on the base A is arcuate to conform to the generally uniform curvature normally assumed by the sling-type seat C, and thus the seat base A imparts little if any distortion to the highly flexible seat C.

The seat base A possesses a generally rectangular configuration and as such has parallel side margins 4, a front margin 6, and a rear margin 8 (FIGS. 2 & 3). Along its side margins 4, the base A has flat side strips 10 which are wide enough to overlie those members of the wheelchair side frames to which the sling-type seat C is attached. Indeed, the spacing between the two side strips 10 equals the spacing between the seat-supporting members of the wheelchair side frames when the frames are spread apart to the open position for the wheelchair. The side strips 10 may be trimmed down to reduce the overall width of the seat base A. Between the two side strips 10 lie a succession of transversely directed panels 12 and ribs 14, with the latter separating the former. In other words, the panels 12 and ribs 14 are arranged alternately, each extending essentially from one side strip 10 to the other. The panels 12 establish the upper contour s, while the ribs 14 establish the arcuate lower contour t.

Figures 4, 5, 6, 7, 8:
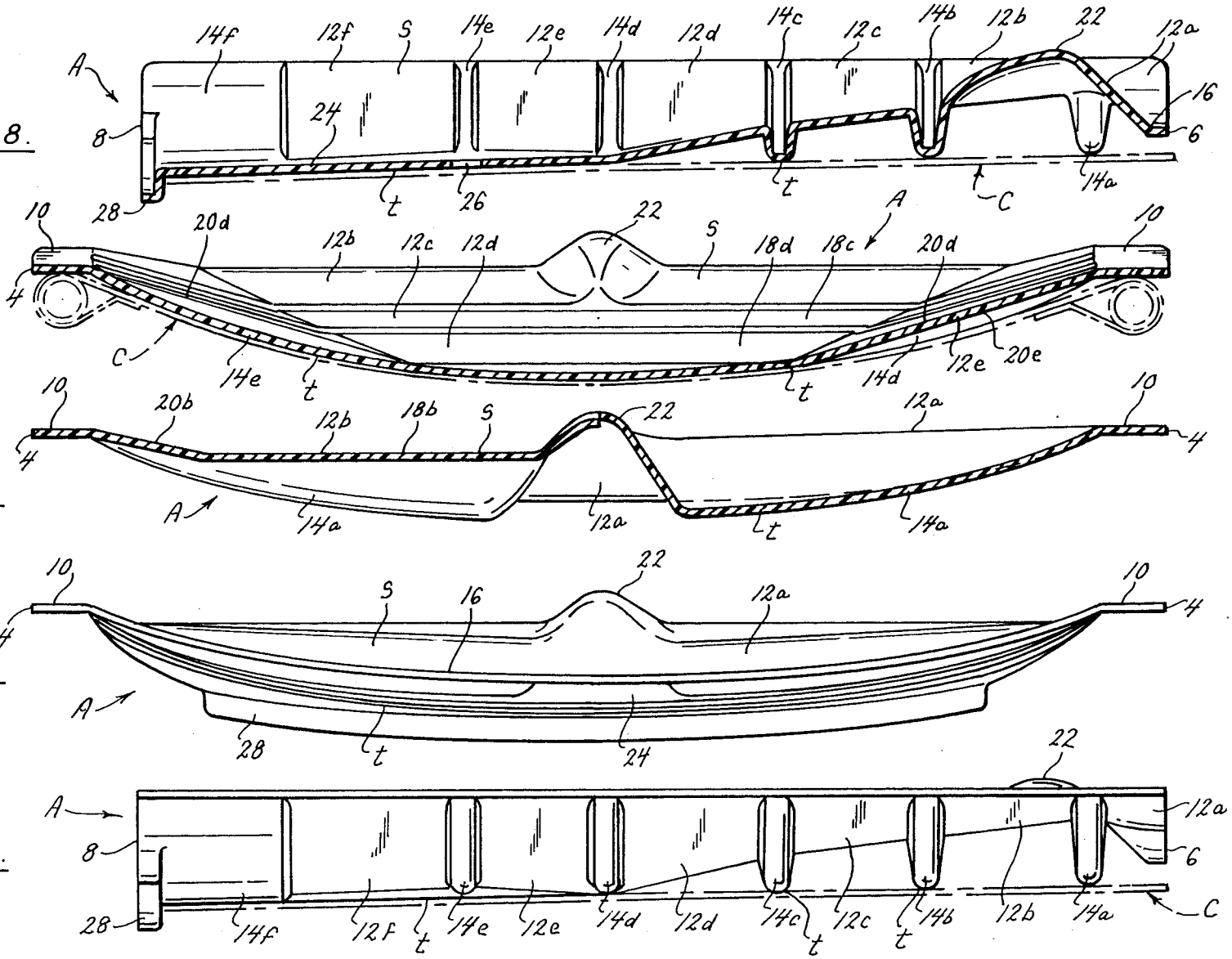
FIG. 4 is a side elevational view of the seat base taken along line 4—4 of FIG. 3.
FIG. 5 is a front elevational view taken along line 5—5 of FIG. 3.
FIG. 6 is a sectional view taken along line 6—6 of FIG. 2.
FIG. 7 is a sectional view taken along line 7—7 of FIG. 2.
FIG. 8 is a sectional view taken along line 8—8 of FIG. 2.

The first panel **12*a* lies along the front margin 6 of the seat base B and it is only slightly wider than the first rib 14*a* which lies immediately behind it, and is certainly considerably narrower than the second panel 12*b* which lies immediately behind the first rib 14*a*. Indeed, the first and second panels 12*a,b* are separated from each other by the first rib 14*a* which projects downwardly from the two panels 12*a,b*, leaving a groove between the two panels 12*a,b*, owing to the uniform thickness of the material from which the seat base B is formed. Whereas most of the panels 12 approximate the horizontal in that they do not deviate significantly from it, the first panel 12*a* for the most part slopes downwardly toward the front margin 6 at a relatively steep angle, it being oriented at about 45° with respect to the second panel 12*b*. Actually, a major portion of the first panel 12*a* slopes at a steep angle, whereas the remainder of the panel 12*a* remains generally with the horizontal, with the demarcation between the two portions being a slightly curved line 16 (FIGS. 3 & 8) that is presented forwardly. The second panel 12*b* is composed of a relatively horizontal midportion 18*b* and end portions 20*b* which slope upwardly from the midportion 18*b* and merge with the side strips 10 (FIGS. 3 & 6). The first and second panels 12*a,b* and the intervening first rib 14*a* are all interrupted midway between their ends, that is midway between the side strips 10, by a pommel 22 which projects upwardly from the major surface areas of the two panels 12*a,b*.**

The third panel **12*c*, which is separated from the second panel 12*b* by the second rib 14*b*, is quite similar to second panel 12*b*, but the pommel 22 does not extend into either it or the second rib 14*b*. And while it has a midportion 18*c* and two end portions 20*c*, the midportion 18*c* is shorter than its counterpart in the panel 12*b*, while the end portions 20*c*** are longer than their counterparts.

The fourth panel **12*d* resembles the third panel 12*c*, only its midportion 18*d* is still shorter, whereas its end portions 20*d* are correspondingly longer. The fourth panel 12*d* is separated from the third panel 12*c* by the third rib 14*c***.

The fifth and sixth panels **12*e,f* have end portions 20*e,f* which are about as long as their counterparts in the fourth panel 12*d*, beyond which they lie, and of course the fifth panel 12*e* is separated from the fourth panel 12*d* by the fourth rib 14*d*, while the sixth panel is separated from the fifth panel 12*e* by the fifth rib 14*e* (FIG. 7). However, instead of merging into their own midportions, the end portions 20*e,f* of the fifth and sixth panels 12*e,f* merge into a common bottom section 24 which lies at about the level of the lowest extension of the ribs 12*a,b,c* (FIGS. 2, 3, 7 & 8). Indeed, the bottom section 24 merges into the midportion 20*d* of the fourth panel 12*d*, and thus interrupts the fourth rib 14*d*, so that it is only discernible along the end portions 20*d*. The same holds true with respect to the fifth rib 14*e*, it likewise being interrupted by the bottom section 24. In effect, the bottom section 24 forms a continuation of the fourth and fifth ribs 14*d,e* through the center of the seat base A, and as such serves to define both the upper and lower contours s,t where it exists. The bottom section 24 forms the lowest part of the upper contour s, and at its center it has an aperture 26 which serves to drain any fluids that might flow to and otherwise collect on the panel 24**.

The rear margin 8 of the seat base A lies along the sixth rib **14*f* which is considerably wider than the remaining ribs 14*a–e*–indeed, about as wide as any one of the panels 12*b–e* (FIGS. 2, 4 & 8). As such, it resembles another panel. Moreover, the sixth rib 14*f* near its center lies flush with the bottom section 24, so that a continuous surface exists from the midportion 20*d* of the fourth panel 12*d*, through the bottom section 24 and sixth rib 14*f*, essentially all the way to the rear margin 8. Actually, along the rear margin 8, the wider sixth rib 14*f* has a downwardly directed lip 28** which forms the lowest portion of the seat base A.

The lower surfaces of the ribs **14*a–f* together with the lower surface of the bottom section 24 establish the lower effective contour t of the seat base A, and that contour is slightly convex in the transverse direction, matching the generally uniform shape of an undistorted sling-type seat C on a wheelchair. Thus, the seat base A, when placed on the underlying sling-type seat, conforms perfectly to it, provided that the lip 28 is located beyond the seat C. Indeed, the lip 28 projects downwardly past the rear margin of the seat C and thereby prevents the seat base A from sliding forwardly on the seat C (FIGS. 4 & 8). To achieve even greater stability, a piece of high friction material, such as rubber may be attached to the lower surface of the section 24**. Also, the lower contour t can have other shapes as well. For example, it may be flat.

The upper surfaces of the panels **12*a–f* and the upper surface of the bottom section 24 together with a portion of the upper surface on the last rib 14*f* establish the upper effective contour s for the seat base A, and that contour is somewhat more complex than the lower contour t. It includes the downwardly sloping surface of the narrow first panel 12 as well as the elevated surface of the pommel 22. It also includes a generally planar center surface 30 (FIG. 2) which slopes gently downwardly from the first rib 14*a* and is composed of the midportions 18*b–d* of the second, third and fourth panels 12*b–d*. The surface 30 merges at a slight angle into the bottom section 24, which extends generally horizontally, and the back section 24*c* in turn merges into the center portion of the sixth rib 14*f*. The center surface 30 and bottom panel 24 lie between two side surfaces 32 which slope gently downwardly, toward them from the side strips 10, the two side surfaces 32 being formed from the end portions 20*b–f* of the second through sixth panels 12*b–f*.**

When the cushion B is placed on the base A, it assumes the shape of the upper contour s for the base A. As such, it slopes gently downwardly from front to rear in conformance with the center surface 30, while its sides will slope slightly in conformance with the side surfaces 32. The slight front-to-rear slope imparted by the center surface 30 serves to prevent the user from falling forwardly, while the side slope imparted by the side surfaces imparts a cradle-like configuration. But the cradle is very slight, so the cushion B does not overly confine the user as it might if it were placed directly against the sling-type seat C. The pommel 22 tends to form, within the front of the cushion B, separate troughs which cradle the user's legs individually and thus maintain the legs in the proper position.

The panels 12*a–f* occupy enough of the upwardly presented surface of the seat base A to enable the base A to form in and of itself a seating surface without inflicting any discomfort on a healthy occupant. Similarly, the seat base A along its side strips 10 may be attached to the side frames of a wheelchair in the absence of the sling-type seat C, for the base A has enough strength and rigidity to support the occupant between the two side frames.

A modified seat base E (FIGS. 9-16) has panels 32*a–e*, with all but the first being about the same width. The first panel 12*a* is quite narrow and terminates at a vertical forwardly presented surface. Separating the panels 32*a–e* are ribs 34*a–d*. Through the centers of the first two panels 12*a,b* a pommel 36 extends, and while it also passes into the third panel 12*c*, it blends into and terminates within that panel. On each side of the pommel 36, the first three panels 32*a–c* are slightly concave and thus conform to the shape of the user's legs.

The first rib 34*a* provides a convenient location at which to cut the seat base E and thereby shorten it to perhaps better accommodate an underlying surface. Indeed, additional ribs may be incorporated into the panel 32*b* to provide additional parting lines.

Figure 9:
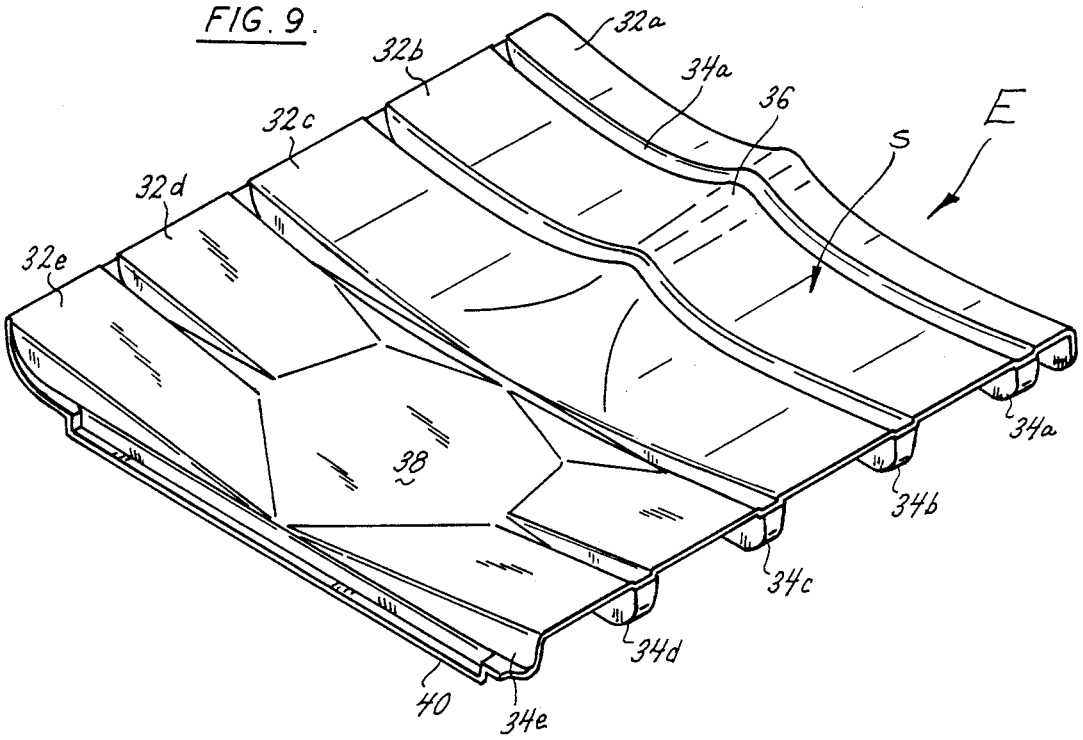
FIG. 9 is a top perspective view of a modified seat base.
Figure 10:
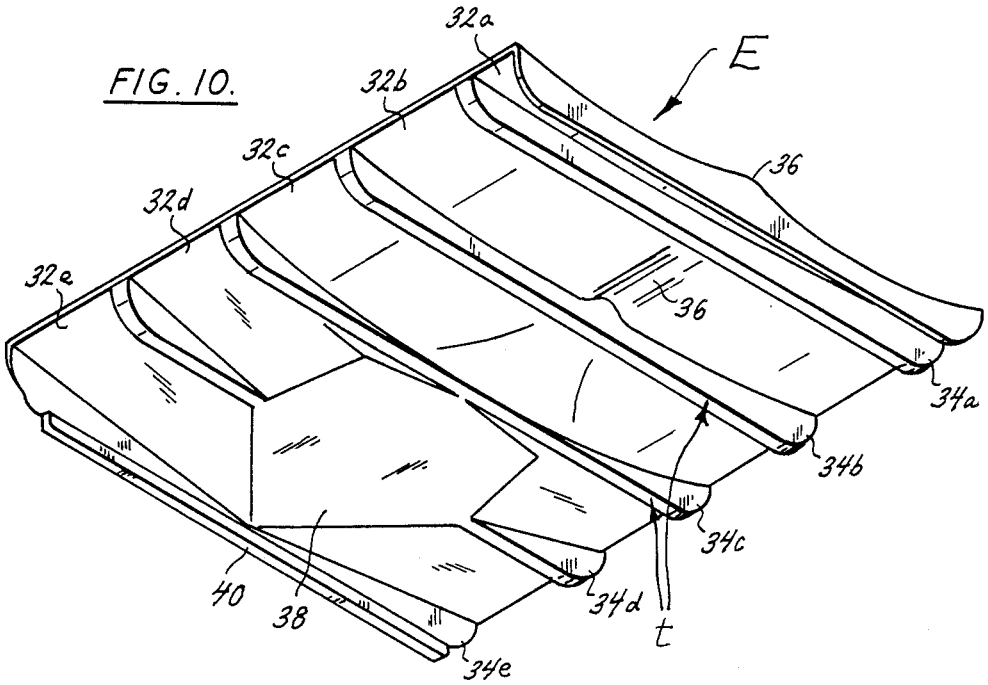
FIG. 10 is a bottom perspective view of the modified seat base.

The fourth and fifth panels 32*d,e* slope downwardly to a common bottom section 38 into which the fourth rib 34*d* merges. The last panel 32*e* has a lip 40 formed on it, and it projects downwardly to an extend greater than the ribs 34 and as such forms the lowest part of the base E. In contrast to the ribs 14 of the base A, which are curved, the ribs 34 of base E are straight for essentially the full width of the base. The panels 32 establish the upper effective contour s for the base E and that contour is quite similar to the contour s of the base A (FIG. 9). The ribs 34 together with the bottom section 38 establish the lower effective contour t of the base E, and in contrast to the curvature of the contour t for the base A, the contour t for the base E is essentially flat (FIG. 10).

While the base E may be placed on a sling-type seat C of a wheelchair, it is better suited for use on flat surfaces which are likewise of uniform contour and as such never very comfortable as seating surfaces. When the base E is so placed, its upper contour s provides a much more comfortable seating surface.

Figure 17:
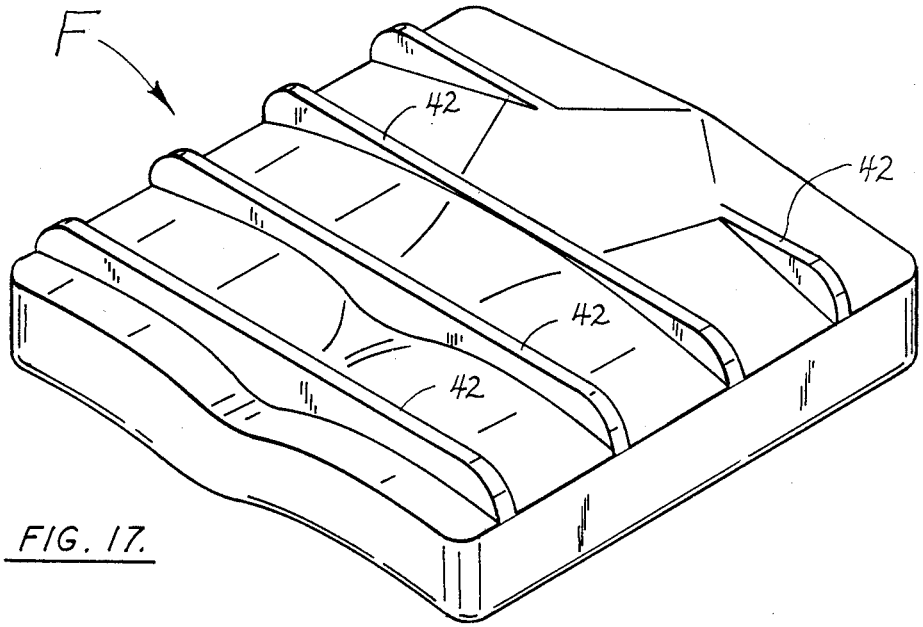
FIG. 17 is a plan view showing the bottom of a molded foam cushion for use on the modified seat base.
Figure 11:
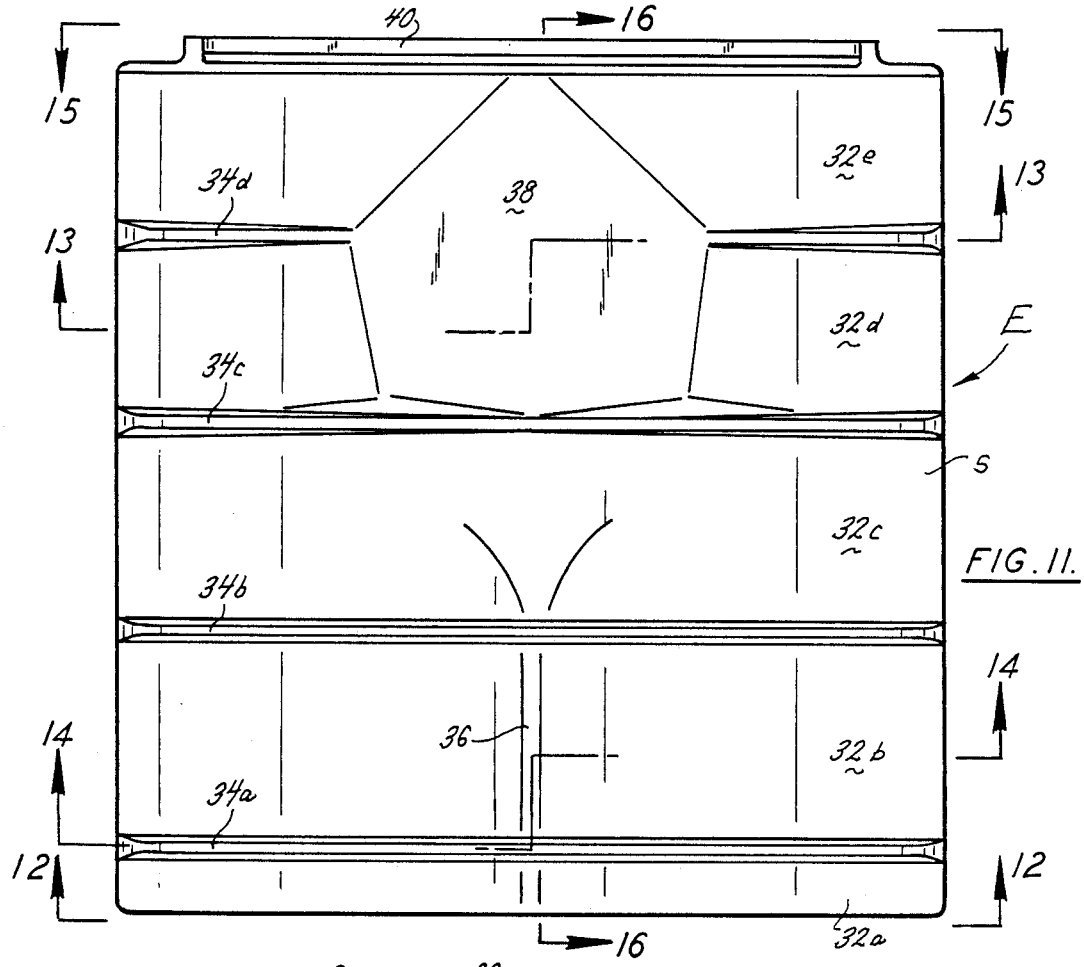
FIG. 11 is a top plan view of the modified seat base.
Figure 12:
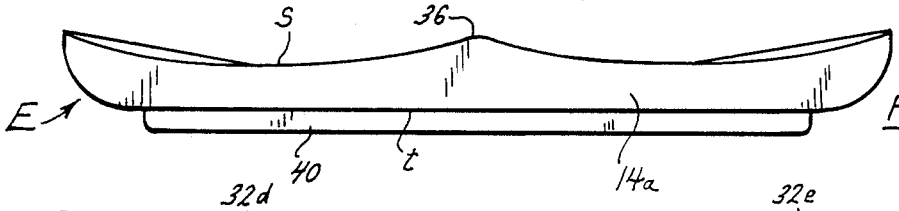
FIG. 12 is a front elevational view of the modified seat base taken along line 12—12 of FIG. 11.
Figure 13:
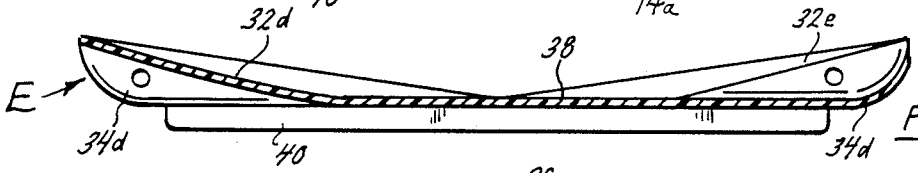
FIG. 13 is a sectional view taken along line 13—13 of FIG. 11.
Figure 14:
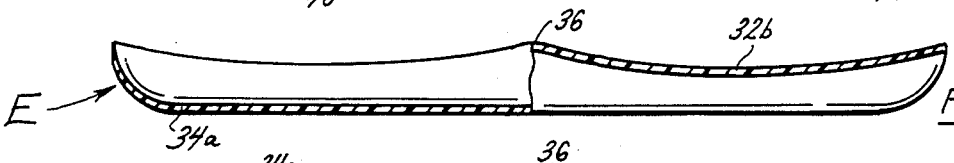
FIG. 14 is a sectional view taken along line 14—14 of FIG. 11.
Figure 15:
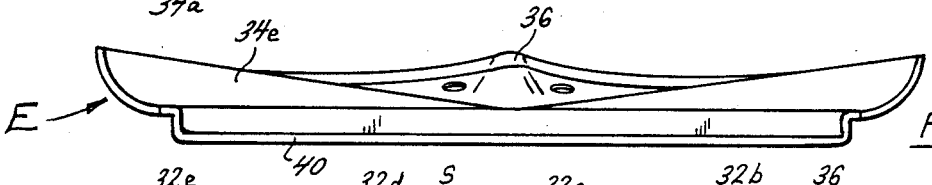
FIG. 15 is a rear elevational view taken along line 15—15 of FIG. 11.
Figure 16:
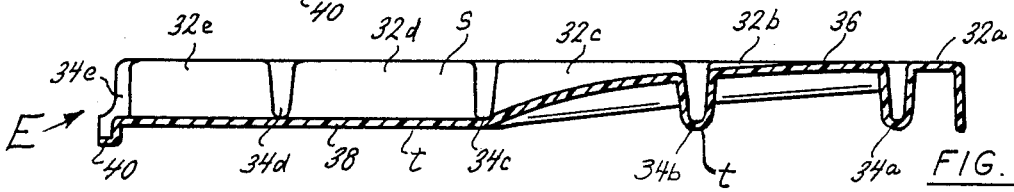
FIG. 16 is a sectional view taken along line 16—16 of FIG. 11.

The seat bases A and E serve as excellent supports for molded seat cushions F (FIG. 17) as well as cellular cushions B. Again the upper surface s of the seat base A or E controls the contour of the cushion F whether it be cellular or molded. The cushion F, on its under surface, may have cleats 42 that project downwardly into the grooves formed by the ribs 14 or 34, and this serves to retain the cushion F in place.

This invention is intended to cover all changes and modifications of the example of the invention herein chosen for purposes of the disclosure which do not constitute departures from the spirit and scope of the invention.

What is claimed is:

1. A seat base formed from a substantially rigid material of generally uniform thickness, said seat base having spaced apart sides and a plurality of spaced apart ribs which extend transversely toward the sides and project downwardly, the ribs being generally hollow and creating upwardly opening grooves, the seat base also having panels located between the grooves with the panels being generally wider than the ribs, the upwardly presented surfaces of the panels establishing an upper effective contour which is suited for seating purposes, in that it is at least in part slightly concave, and the downwardly presented surfaces of the ribs establishing a lower effective contour which is substantially different from the upper effective contour in that the spacing between the downwardly presented surfaces of at least some of the ribs and the panels adjacent to those ribs varies along the lengths of the ribs, so that none of those ribs possesses a uniform height, the lower effective contour being generally uniform to conform to an underlying supporting surface of generally uniform shape.

2. A seat base according to claim 1 which is generally rectangular in configuration, having front and rear margins in addition to the sides; and further comprising a downwardly directed lip along the rear margin.

3. A seat base according to claim 1 wherein at least two of the panels and one of the ribs merge midway between the sides into a generally flat common section in which the distinction between those panels and the rib is obliterated, whereby the common section establishes both the lower and upper effective contours where it is located.

4. A seat base according to claim 3 wherein the seat base is rectangular, having front and rear margins in addition to its sides; wherein the common section is located closer to the rear margin than to the front margin; and wherein panels are shaped to provide the upper contour with a center surface that slopes downwardly from the front margin to the common section and side surfaces which slope downwardly from the sides toward the center surface and the common section.

5. A cushion according to claim 4 wherein the panel at the front margin and the panel adjacent to that panel together with the rib that is between them are deformed intermediate their ends to provide a raised pommel in the seat base.

6. A seat base according to claim 3 wherein the rear margin is along a rib that is wider than the remaining ribs, and the generally flat common section lies extends into and occupies a part of the wider rib midway between the ends of that rib.

7. A seat base according to claim 1 and further comprising flat side strips located at the sides of the base beyond the ends of the ribs.

8. A seat base according to claim 1 wherein the seat base is rectangular, having front and rear margins in addition to its sides, and the rear margin is along a rib, with that rib being wider than the other ribs.

9. A seat base according to claim 1 wherein the ribs at the front of the seat base serve as parting lines for removing a segment of the seat base and thereby shortening the seat base.

10. In combination with the seat base of claim 1, a flexible cushion resting on the base and shaped by the upper contour of the base.

11. In combination with the seat base of claim 1 a flexible cushion resting on the base, the cushion having on its undersurface cleats which project into the grooves in the upwardly presented surface of the seat base.

12. In combination with a wheelchair having a sling-type seat of generally uniform contour and a cushion located over and supported by the seat, a generally rigid seat base interposed between the seat and the cushion, the seat base having sides and transversely directed ribs which extend toward the sides and project downwardly toward the sling-type seat, the ribs being generally hollow so as to create grooves which open upwardly toward the cushion, the seat base also having panels located between the grooves, the downwardly presented surfaces of the ribs forming an effective lower contour which generally matches the uniform contour of the sling-type seat and the upwardly presented surfaces of the panels forming an effective upper contour which imparts a desired shape to the cushion, the upper contour being substantially different from the lower contour.

13. The combination according to claim 12 wherein the base is rectangular in configuration and includes a front margin and a rear margin, and further comprises a lip which projects downwardly from the base at the rear margin thereof and is located behind the sling-type seat to prevent the base from sliding forwardly off the seat.

14. In combination with a substantially horizontal supporting surface of generally uniform shape, such as a sling-type seat on a wheelchair or a flat horizontal surface, a generally rigid base for providing a contour more suited for seating, said base having spaced apart sides and a plurality of spaced apart ribs which extend transversely toward the sides, the ribs projecting downwardly toward the supported surface, the base further having panels located between the ribs, with the panels being generally wider than the ribs, the upwardly presented surfaces of the panels establishing an upper effective contour which is concave in part and is otherwise suited for seating purposes, and the downwardly presented surfaces of the ribs establishing a lower effective contour which conforms to the generally uniform supporting surface, the upper effective contour being substantially different from the lower effective contour in that the spacing between the downwardly presented surfaces of at least some of the ribs and the panels adjacent to those ribs varies along the length of the ribs, so that none of those ribs possesses a uniform height.

15. The combination according to claim 14 wherein at least some of the ribs extend substantially from side to side without interruption.

16. The combination according to claim 14 wherein the ribs are essentially hollow and form grooves which open upwardly between the panels.

17. The combination according to claim 14 wherein the seat base has spaced apart front and rear margins which extend between its sides, and the upper effective contour includes an upwardly projecting pommel located along the front margin intermediate the sides, a depressed section located behind and below the pommel and surfaces that slope downwardly from the sides toward the depressed section.

18. The combination according to claim 17 wherein the upper effective contour on both sides of the pommel further includes surfaces that slope downwardly from the front margin to the depressed section.

19. The combination according to claim 18 wherein the depressed section interrupts at least one of the transversely extending ribs.

20. The combination according to claim 14 wherein the seat base further includes along its rear margin a lip which projects downwardly below the lower effective contour and the supporting surface.

* * * * *